US009419382B2

(12) United States Patent
Wu et al.

(10) Patent No.: US 9,419,382 B2
(45) Date of Patent: Aug. 16, 2016

(54) CABLE CONNECTOR ASSEMBLY WITH IMPROVED SPACER

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Xiao Fan, Kunshan (CN); Zhi-Yong Zhou, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/734,242

(22) Filed: Jun. 9, 2015

(65) Prior Publication Data

US 2015/0357765 A1 Dec. 10, 2015

(30) Foreign Application Priority Data

Jun. 9, 2014 (CN) ..... 2014 1 0249285

(51) Int. Cl.

| | |
|---|---|
| ***H01R 9/03*** | (2006.01) |
| ***H01R 13/6581*** | (2011.01) |
| ***H01R 13/436*** | (2006.01) |
| *H01R 107/00* | (2006.01) |
| *H01R 24/64* | (2011.01) |

(52) U.S. Cl.

CPC ..... *H01R 13/6581* (2013.01); *H01R 13/4367* (2013.01); *H01R 9/03* (2013.01); *H01R 24/64* (2013.01); *H01R 2107/00* (2013.01)

(58) Field of Classification Search

CPC ..... H01R 13/6658; H01R 13/658; H01R 13/65802; H01R 13/506; H01R 23/6873; H01R 23/7073; H01R 43/24; H01R 9/032

USPC ..... 439/607.58, 607.54, 607.5, 607.41, 439/607.27

See application file for complete search history.

(56) References Cited

U.S. PATENT DOCUMENTS

| | | | | |
|---|---|---|---|---|
| 5,364,292 | A * | 11/1994 | Bethurum | H01R 13/6599 439/607.02 |
| 5,658,170 | A * | 8/1997 | Tan | H01R 9/034 439/607.41 |
| 5,733,146 | A * | 3/1998 | Block | H01R 13/65802 439/553 |
| 2014/0011385 | A1 * | 1/2014 | Wu | H01R 13/646 439/345 |

(Continued)

*Primary Examiner* — Abdullah Riyami
*Assistant Examiner* — Vladimir Imas
(74) *Attorney, Agent, or Firm* — Ming Chieh Chang; Wei Te Chung

(57) ABSTRACT

A cable connector assembly including: a cable including a number of wires, an insulative housing, a number of contacts retained in the insulative housing and soldered to corresponding wires of the cable, a spacer assembled to the insulative housing and retaining respective rear portions of the contacts, a metal case enclosing the insulative housing and having a slit, a copper foil enclosing the metal case and covering the slit, and an insulative member over-molded on the copper foil and a front end of the cable, wherein the spacer defines a sustaining portion extending into the slit for supporting a portion of the copper foil located above the slit.

8 Claims, 9 Drawing Sheets

(56) References Cited

U.S. PATENT DOCUMENTS

2014/0213109 A1* 7/2014 Wu ..... H01R 24/62
439/607.01
2014/0349523 A1* 11/2014 Peng ..... H01R 13/6593
439/701
2015/0050836 A1* 2/2015 Wu ..... H01R 13/4367
439/607.01
2015/0068803 A1* 3/2015 Wu ..... H01R 13/4367
174/94 R
2015/0188262 A1* 7/2015 Wu ..... H01R 13/6593
439/607.55
2015/0188268 A1* 7/2015 Wu ..... H01R 13/6582
439/607.55
2015/0229066 A1* 8/2015 Wu ..... H01R 13/6593
439/660
2015/0288079 A1* 10/2015 Wu ..... H01R 13/6593
439/660
2015/0357765 A1* 12/2015 Wu ..... H01R 13/6581
439/607.58
2016/0043517 A1* 2/2016 Wu ..... H01R 9/0515
439/629

* cited by examiner

CABLE CONNECTOR ASSEMBLY WITH IMPROVED SPACER

BACKGROUND OF THE INVENTION

1. Field of the Invention

The present invention relates to a cable connector assembly, and more particularly to a cable connector assembly having improved shielding effect.

2. Description of Related Art

Universal Serial BUS (USB) is a widely used input/output interface adapted for many electronic devices, such as personal computers and related peripherals. Nowadays, USB forum has published several specification editions for USB, and transmitting rate of USB has become higher and higher. As electronic industry develops, higher transmitting rate of USB based connection accessory is needed.

A USB 3.0 POWER-B cable connector assembly usually includes an electrical connector, a cable electrically connected with the electrical connector, and an insulative member over-molded around the electrical connector and a front portion of the cable. The electrical connector includes an insulative housing and a metal case enclosing the insulative housing. The insulative housing usually defines a narrower upper portion and a wider lower portion. Due to the limits of manufacturing technology, a slit is formed on two opposite sides of the metal case. Therefore, the cable connector assembly further includes a copper foil enclosing the metal shell to enhance the shielding effect. However, when the insulative member is over-molded, the copper foil located at the slit is easily broken for a lack of effective support by the metal case.

Hence, a cable connector assembly with improved spacer is desired to overcome the above problems.

BRIEF SUMMARY OF THE INVENTION

According to one aspect of the present invention, a cable connector assembly comprises: a cable including a number of wires, an insulative housing; a plurality of contacts retained in the insulative housing and soldered to corresponding wires of the cable, a spacer assembled to the insulative housing and retaining respective rear portions of the contacts, a metal case enclosing the insulative housing and having a slit, a copper foil enclosing the metal case and covering the slit, and an insulative member over-molded on the copper foil and a front end of the cable, wherein the spacer defines a sustaining portion extending into the slit for supporting a portion of the copper foil located above the slit.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
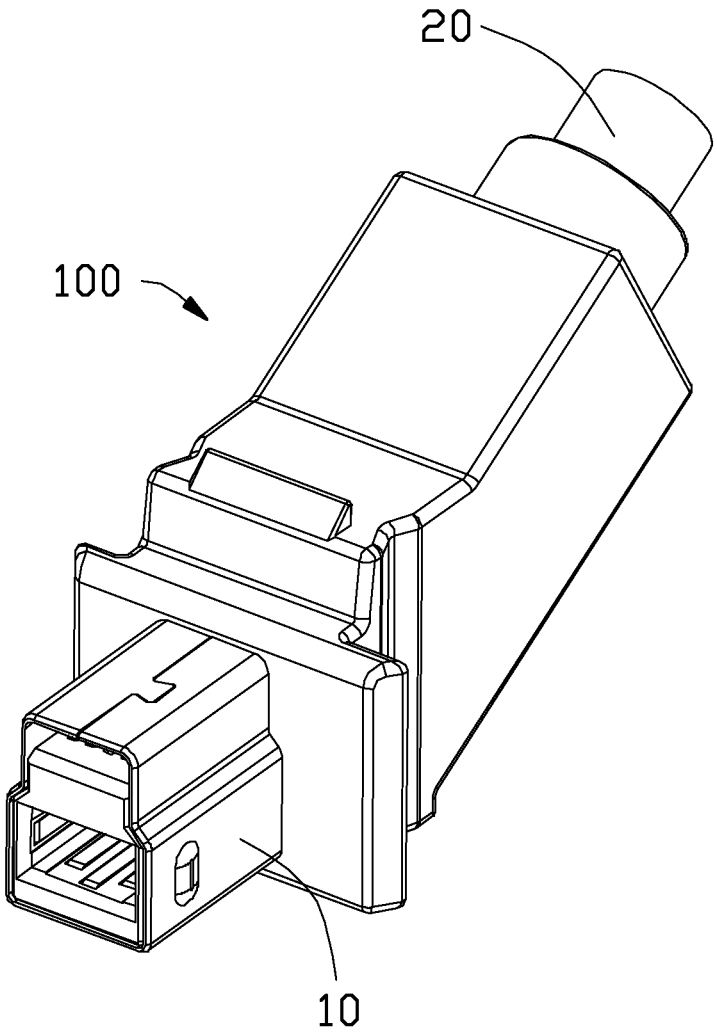
FIG. 1 is a perspective assembled view of a cable connector assembly according to the present invention.
Figure 2:
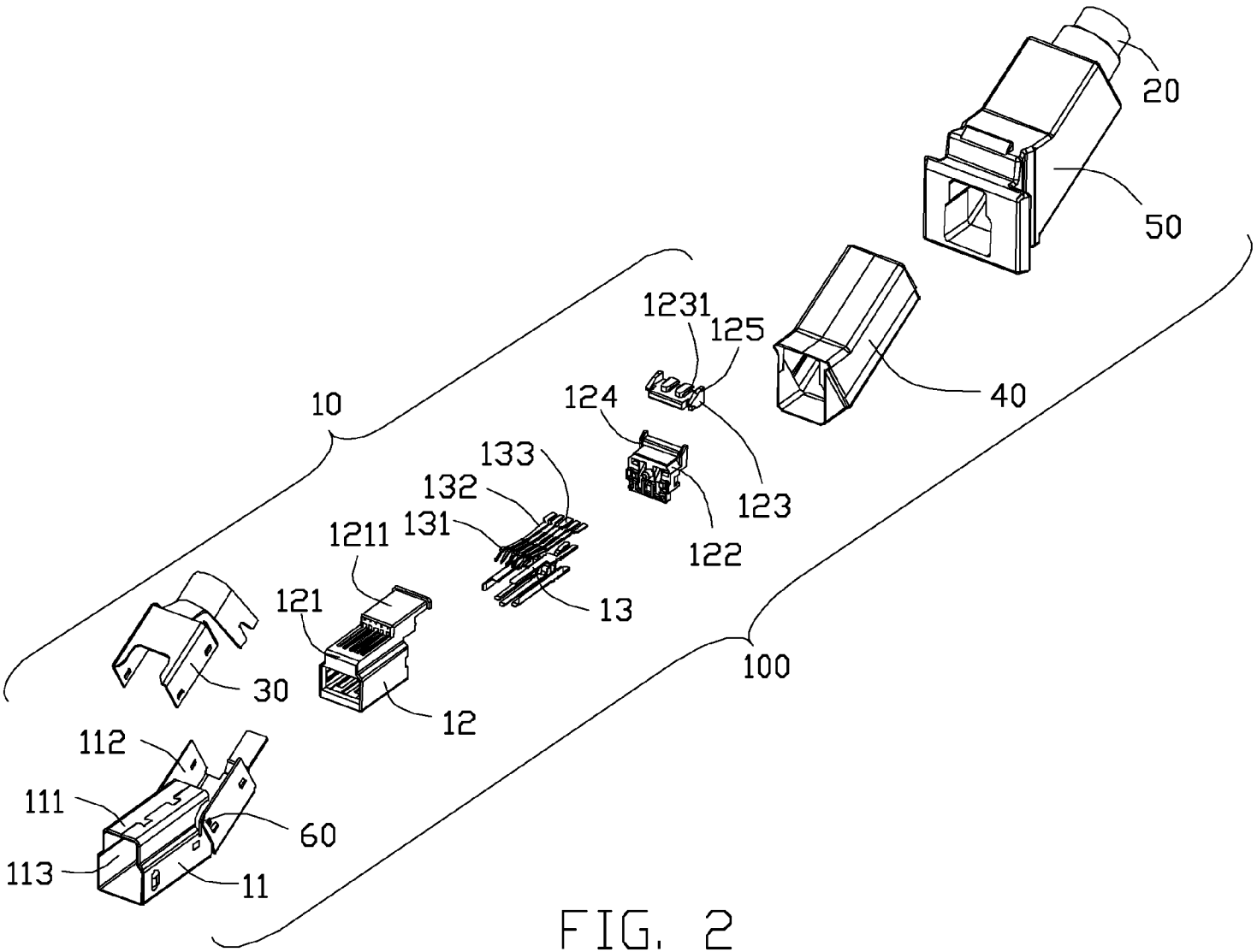
FIG. 2 is an exploded view of the cable connector assembly shown in FIG. 1.
Figure 3:
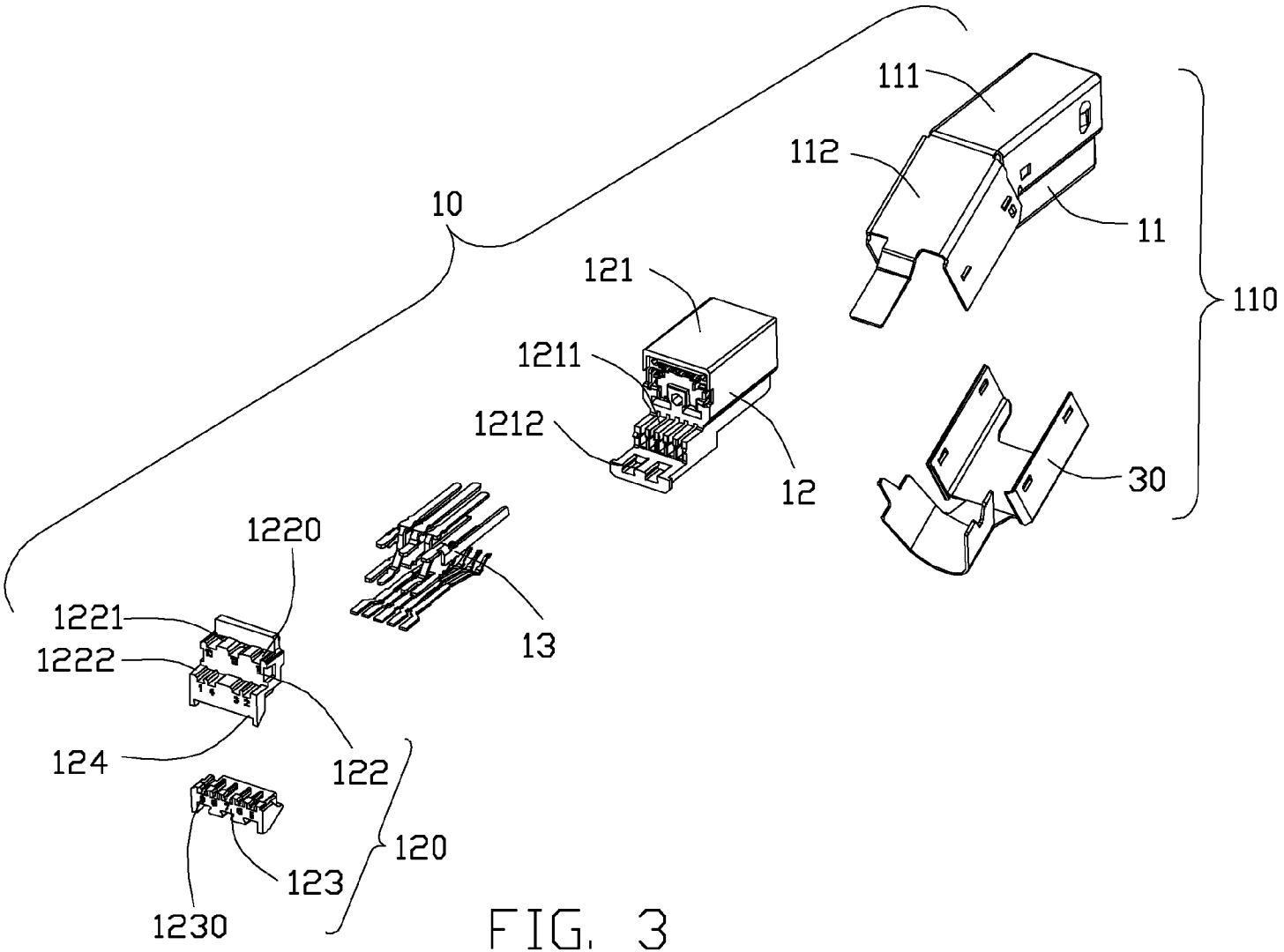
FIG. 3 is a view similar to FIG. 2 but with several elements removed.

Referring to FIGS. 1-2, a cable connector assembly 100 according to a preferred embodiment of the present invention includes an electrical connector 10, a cable 20 electrically connecting to the electrical connector 10, a copper foil 40 enclosing a conjunction area between the electrical connector 10 and the cable 20, and an insulative member 50 over-molded around the copper foil 40.

Referring to FIGS. 3-6, the electrical connector 10 includes a metal case 110, an insulative housing 12 contained in the metal case 110, a spacer 120 assembled to a rear end of the insulative housing 12, and a number of contacts 13 retained in the insulative housing 12. The metal case 110 includes a first case 11 and a second case 30 engaged with the first case 11. The cable 20 includes a number of wires for transmitting electrical signals, and the wires are electrically connected to the corresponding contacts 13.

Referring to FIGS. 2-5, the first case 11 includes a tubular portion 111 and a drawer-shaped portion 112 obliquely and upwardly extending from a rear end of the tubular portion 111 along a front-to-back direction. A receiving space 13 is formed by four conjunctive walls of the tubular portion 111, and the width of a top wall is less than the width of a bottom wall, thus symmetrically, two step-shaped portions are formed on the two side walls respectively. Two sidewalls of the drawer-shaped portion 112 respectively are against the outside of the two sidewalls of the tubular portion 111 and fixed to the corresponding sidewall at the overlapping part. A slit 60 is formed between a side wall of the drawer-shape portion 112 and an upper portion of the tubular portion 111. The seconded case 30 includes a top cap 31 and an installation portion 32 extending vertically downwards from two opposite sides of the top cap 31. The top cap 31 has a U-shaped groove 311 and two shielding portions 312 beside the U-shaped groove 311. The Installation portion 32 encloses the top part of the drawer-shaped portion 112, and the top portion of the first case 11 extends through the U-shaped groove 311 and is exposed above the top cap 31. The shielding portions 312 cover the slits 60.

Referring to FIGS. 2-6, the insulative housing 12 includes a main body 121 and a fixing member 1211 unitarily extending from a rear end of the main body 121 along a front-and-rear direction. The main body 121 is received in the receiving space 113 of the first case 11. A number of dovetail slots 1212 are defined on the bottom side of the fixing member 1211. The spacer 120 includes a first spacer 122 and a second spacer 123, and both are fixed to the rear portion of the main body 121 under the fixing member 1211 and received in the receiving space 113 together with the insulative housing 12, and a bottom sidewall of second spacer 123 abuts a top sidewall of the first spacer 122. A rear side of the first spacer 122 defines a first step 1221 and a second step 1222 along a bottom-and-top direction. Both bottom sidewalls of the first step 1221 and the second step 1222 define a number of receiving slots 1220 along a first direction which a plug connector is inserted or withdrawn, and the receiving slots 1200 extend through the first spacer 122 from a front sidewall to a rear sidewall thereof A number of receiving slots 1230 are defined through the second spacer 123 from the front sidewall to the rear sidewall thereof A number of fixing blocks 1231 corresponding to the dovetail slots 1212 of the fixing member 1211 are defined on the top side of the second spacer 123. The fixing blocks 1231 are received and fixed in the corresponding dovetail slots 1212 for fixing the second spacer 123 to the bottom of the fixing member 1211.

Referring to FIGS. 2-6, the contact 13 includes a contacting portion 131, a fixing portion 132 retained in the insulative housing 12, and a soldering portion 133 for soldering with the cable wire. The soldering portions 133 of the contacts 13 are respectively received in the receiving slots 1220 and the receiving slots 1230. The soldering portions 133 are soldered to the corresponding wires of the cable 20.

Figure 4:
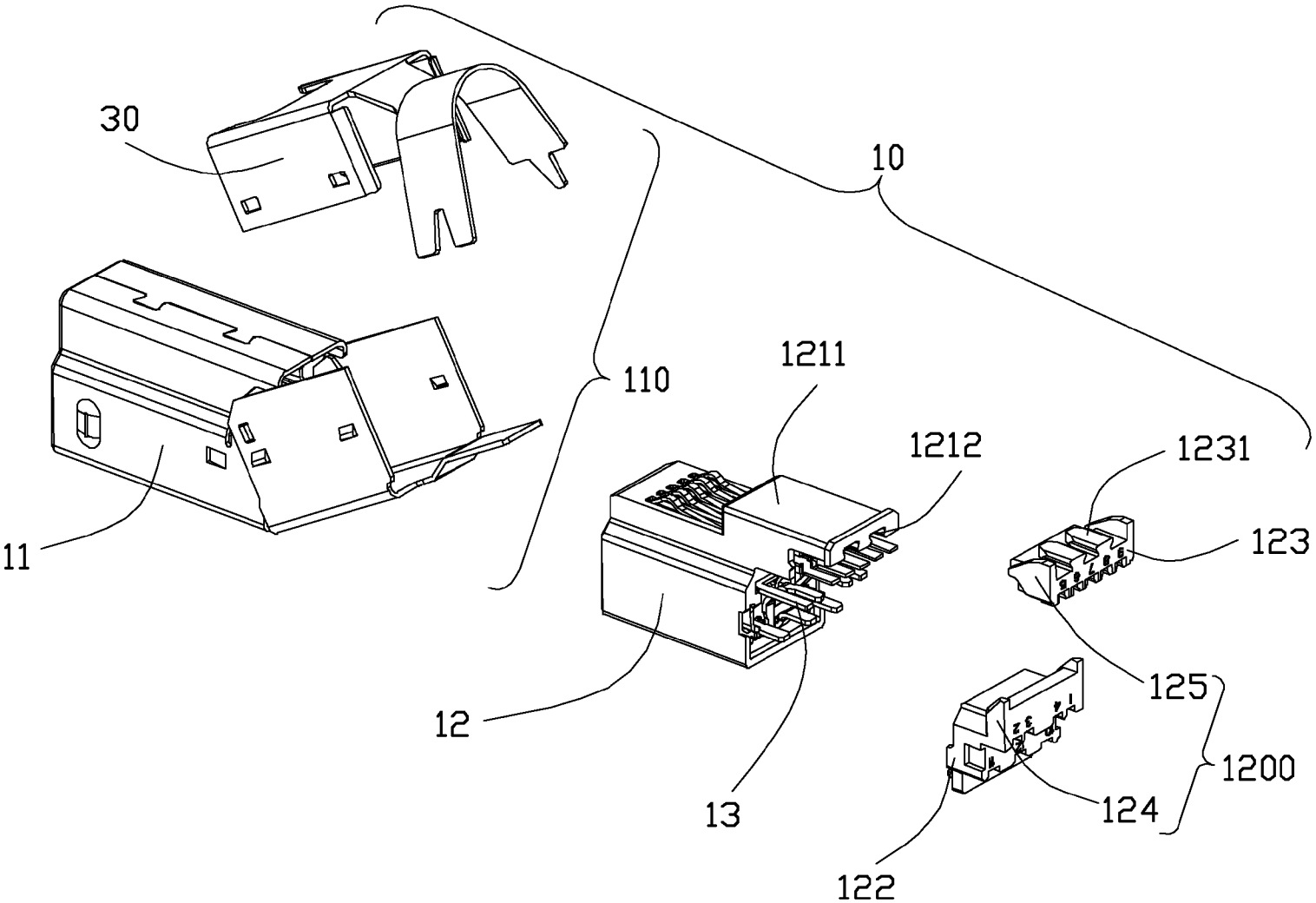
FIG. 4 is partly assembled view of the electrical connector shown in FIG. 3, but from a different perspective.
Figure 5:
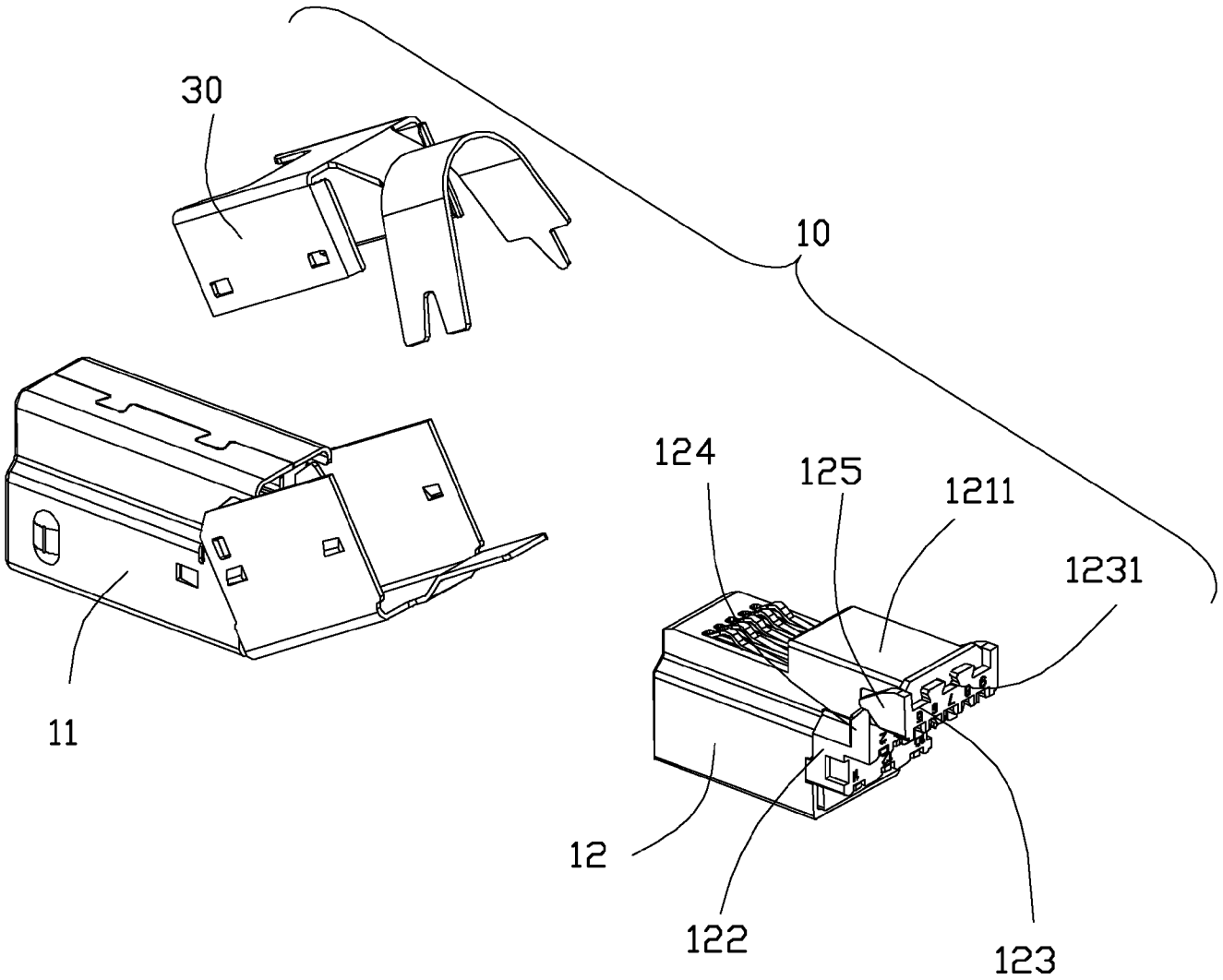
FIG. 5 is a further assembled view of the electrical connector shown in FIG. 4.
Figure 6:
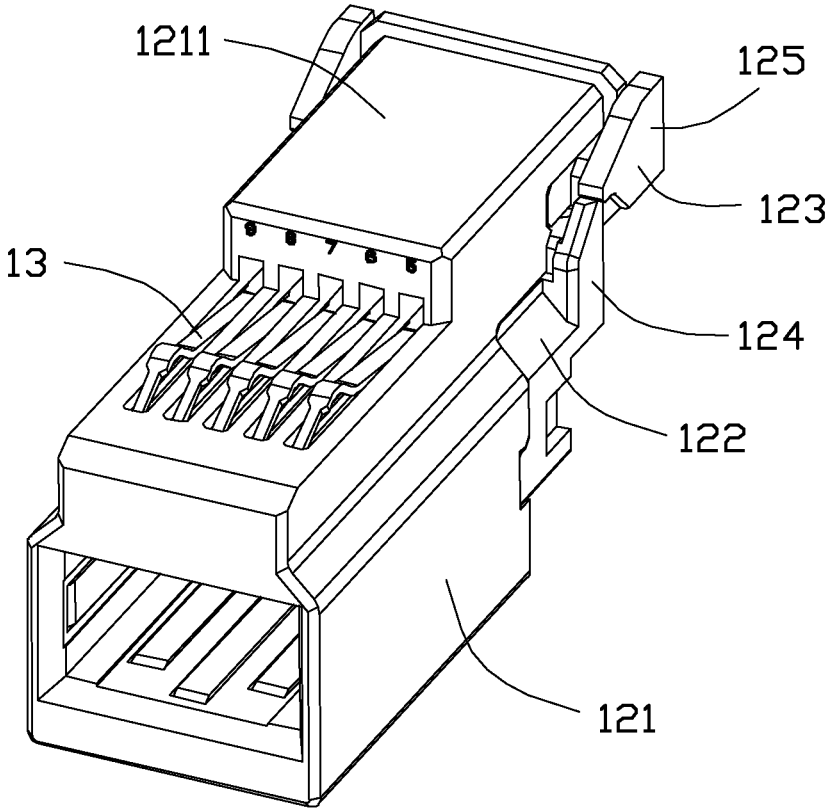
FIG. 6 is a different perspective view from FIG. 5 with several elements removed.
Figure 7:
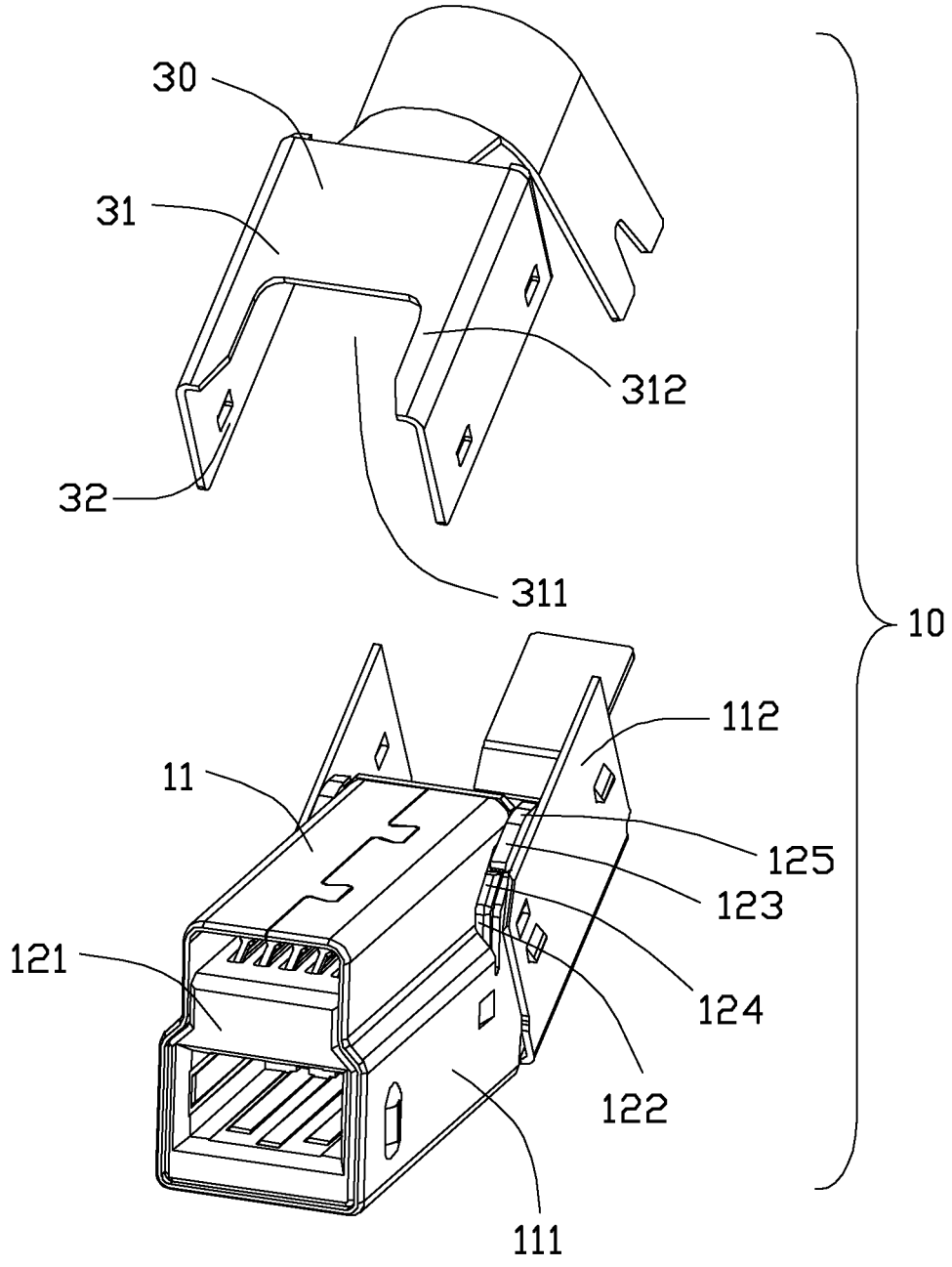
FIG. 7 is a further assembled view of the electrical connector shown in FIG. 5.
Figure 8:
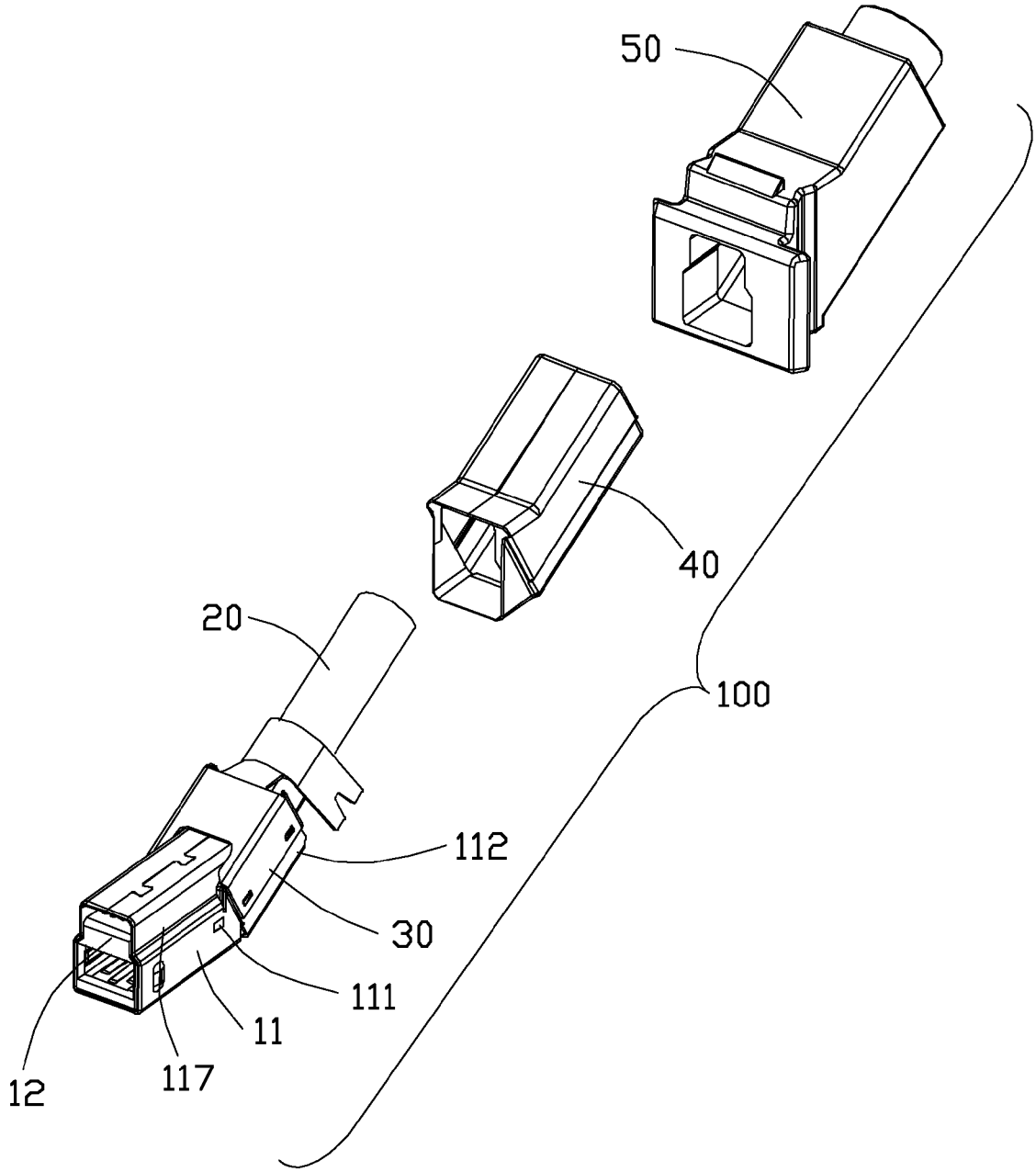
FIG. 8 is a partly assembled view of the cable connector assembly shown in FIG. 2.
Figure 9:
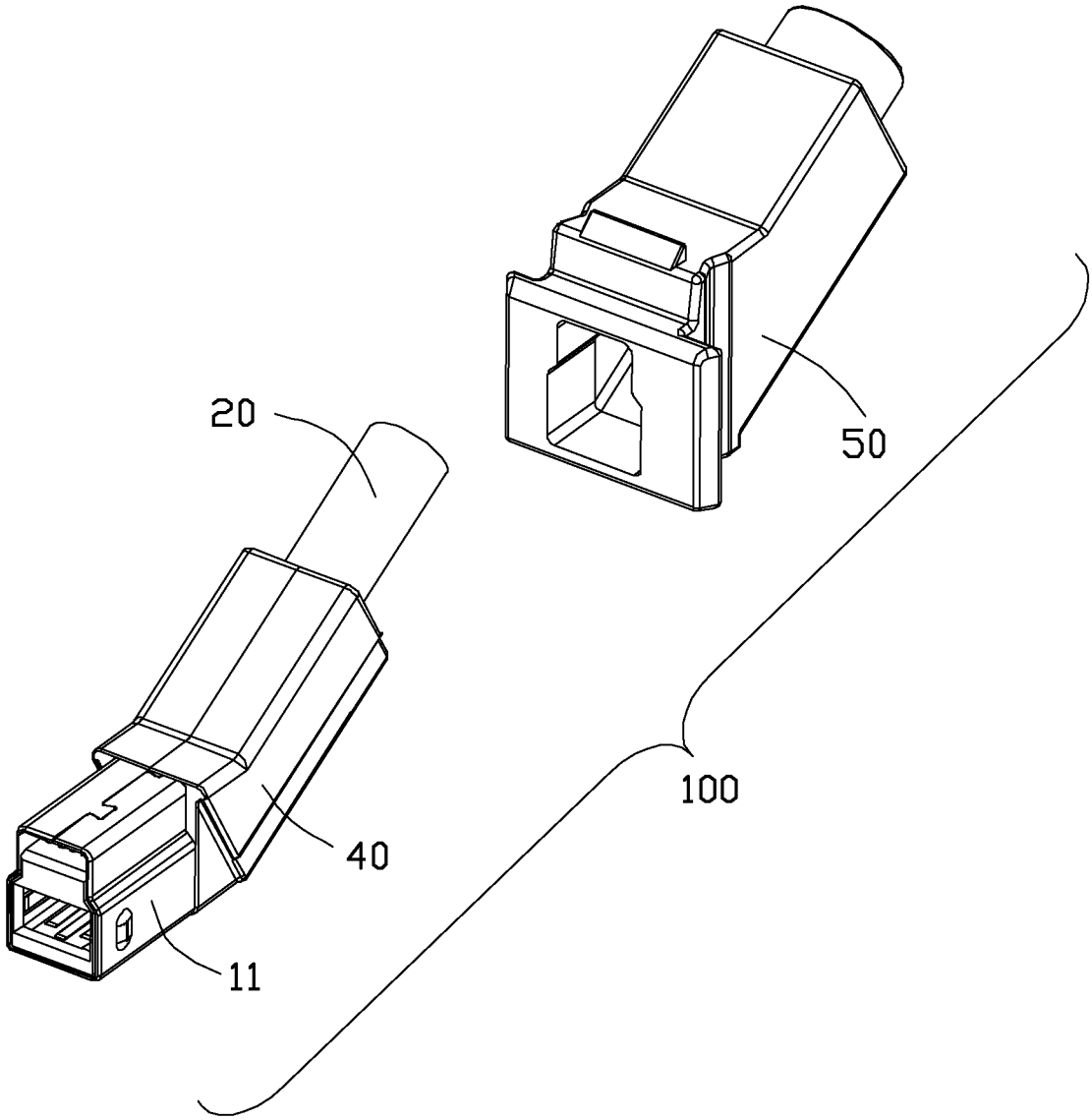
FIG. 9 is a further assembled view of the cable connector assembly shown in FIG. 8.

Referring to FIGS. 4-6, a sustaining portion 1200 is defined on the spacer 120. The sustaining portion 1200 includes a first sustaining portion 124 outwardly extending from the two opposite ends of the first spacer 122 and a second sustaining portion 125 outwardly extending from the two opposite ends of the second spacer 123. The first sustaining portion 124 and the second sustaining portion 125 are received in the slit 60 of the first case 11 to fill the slit 60.

Referring to FIGS. 1-9, in assembling, firstly, the contacts 13 are retained in the insulative housing 12. The spacer 120 then is fixed to the rear portion of the insulative housing 12 and receives the rear ends of the contacts 13. The wires of cable 20 are soldered to the corresponding contacts 13. The combination of the insulative housing 12, the spacer 120, the contacts 13, and the cable is received in the receiving space 113 of the tubular portion 111. The second case 30 is engaged with the drawer-shaped portion 112. The copper foil 40 encloses the rear portions of the first case 11 and the second case 30 and the front portion of the cable 20. The insulative member 50 is over-molded around the copper foil 40, and the front portion of the first case 11 is exposed to the outside of the insulative member 50.

As shown and described, the sustaining portion 1200 extending from the spacer 120 fully fills the slits 60 so that the inner side of the copper foil 40 can be fully supported by the sustaining portion 1200 when the copper foil 40 covers the first case 11 and the second case 30, insuring the copper foil 40 not to be broken during over-molding the insulative member 50 and thus not affecting the shielding effect of the cable connector assembly.

What is claimed is:

1. A cable connector assembly comprising:

a cable including a plurality of wires;

an insulative housing;

a plurality of contacts retained in the insulative housing and soldered to corresponding wires of the cable;

a spacer assembled to the insulative housing and retaining respective rear portions of the contacts;

a metal case enclosing the insulative housing and having a slit;

a copper foil enclosing the metal case and covering the slit; and an insulative member over-molded on the copper foil and a front end of the cable;

wherein the spacer defines a sustaining portion extending into the slit for supporting a portion of the copper foil located above the slit.

2. The cable connector assembly according to claim 1, wherein the metal case comprises a first case and a second case engaged with the first case, a receiving space is defined in the first case for receiving the insulative housing, and the slit is formed between the first case and the second case and communicates with the receiving space and an exterior.

3. The cable connector assembly according to claim 2, wherein the first case comprises a tube portion and a drawer-shaped portion extending backwards from a rear portion of the tube portion, the slit is formed between a sidewall of the tube portion and a sidewall of the drawer-shaper portion.

4. The cable connector assembly according to the claim 3, wherein the second case defines a U-shaped groove on a top sidewall thereof, a shielding portion is formed beside the groove, the first case extends through the groove, and the shielding portion of the second case covers the top of the slit.

5. The cable connector assembly according to the claim 4, wherein the drawer-shaped portion extends obliquely and upwardly from the tube portion.

6. The cable connector assembly according to the claim 4, wherein the tube portion comprises a top wall, a bottom wall, and a pair of side walls, the width of the top wall is smaller than the width of a bottom wall, the side wall has a pair of step-shaped portions, the receiving space is formed between the four walls, and a top portion of the first case extends through the groove.

7. The cable connector assembly according to claim 1, wherein the spacer comprises a first spacer and a second spacer abutting a top sidewall of the first spacer, the first spacer and the second spacer are assembled to a rear portion of the insulative housing, the sustaining portion comprises a first sustaining portion extending from the first spacer and a second sustaining portion extending from the second spacer, and the first spacer and the second spacer fill in the slit.

8. The cable connector assembly according to claim 1, wherein the spacer defines a number of receiving slots, a rear end of the contact is received in a corresponding receiving slot.

* * * * *